US005426911A

United States Patent [19]

Poplin et al.

[11] Patent Number: 5,426,911

[45] Date of Patent: Jun. 27, 1995

[54] BENCH TOP PIPETTE TIP LOADER

[75] Inventors: Dale Poplin, Draper; Joseph V. Smith, Layton; Gary Stout, Farmington; Royce Herbst, Alpine, all of Utah

[73] Assignee: Sorenson Bioscience, Salt Lake City, Utah

[21] Appl. No.: 152,321

[22] Filed: Nov. 12, 1993

[51] Int. Cl.[6] ..... B65B 23/22; B65B 35/56

[52] U.S. Cl. ..... 53/142; 53/246; 53/251

[58] Field of Search ..... 53/246, 142, 143, 251, 53/250, 249, 244, 544, 158, 534

[56] References Cited

U.S. PATENT DOCUMENTS

| | | | |
|---|---|---|---|
| 477,093 | 6/1892 | Wead . | |
| 2,377,431 | 6/1945 | Lakso . | |
| 2,534,362 | 12/1950 | Magnuson . | |
| 2,615,556 | 10/1952 | Hoopes et al. . | |
| 2,849,980 | 9/1958 | Collins | 53/142 X |
| 2,911,088 | 11/1959 | Ingham, Jr. et al. . | |
| 2,945,335 | 7/1960 | Nicolle | 53/142 |
| 2,995,880 | 8/1961 | Henebry | 53/142 |
| 3,080,033 | 3/1963 | Scott et al. | 53/246 |
| 3,290,857 | 12/1966 | Nydam | 53/142 X |
| 3,365,048 | 1/1968 | Ehrlich et al. . | |
| 3,467,236 | 9/1969 | Dhanda . | |
| 3,884,347 | 5/1975 | Gallagher et al. | 198/254 |
| 4,233,799 | 11/1980 | Caille | 53/246 X |
| 4,498,273 | 2/1985 | Colamussi | 53/142 X |
| 5,335,481 | 8/1994 | Ward | 53/246 X |

*Primary Examiner*—James F. Coan
*Attorney, Agent, or Firm*—Thorpe, North & Western

[57] ABSTRACT

A system for transporting by gravity a single-file series of elongate, tapered articles along an inclined transport path for distribution into receiving slots. The system includes a hopper for holding a supply of the articles and a pair of adjacently parallel rotating cylinders for holding the articles in suspended, sliding contact therebetween. A cleated conveyor belt carries the articles from the bottom of the hopper to a point above the cylinders and drops them onto said cylinders. The base of the hopper defines an inclined movement path to thereby convey articles which might fall from the cylinders back to the conveyor belt. The articles are thus fed by the conveyor onto the cylinders and slide along the gap therebetween to an end location. A series of three gates manipulates the articles one at a time to drop in a vertical orientation into an array of narrowly-tailored receiving slots in a packing rack.

46 Claims, 7 Drawing Sheets

BENCH TOP PIPETTE TIP LOADER

BACKGROUND OF THE INVENTION

1. The Field of the Invention

The present invention relates generally to devices for orienting and feeding articles. More particularly, it concerns a system for orienting hollow, conical pipette tips and feeding said tips one at a time into slots narrowly tailored to receive the tips in a fitted, secured position.

2. The Background Art

Commercial packaging of large quantities of articles often involves the problem of transforming an unorganized supply of the articles into packages ready for shipping. The problem is frequently compounded by the necessity to orient the articles prior to insertion into customized packages. In the case of sterilized articles, it is necessary to package them without human handling to maintain sterilization. Manufacturers and distributors strive to achieve these process steps while maintaining overhead costs at a minimum. This has motivated the development of a number of automated apparatus and methods for packaging large quantities of manufactured articles in a short period of time.

For example, U.S. Pat. No. 3,080,033 (issued Mar. 5, 1963 to G. Scott et al.) discloses a vertical sorting tube passing through guide rings and having an open lower end for dispensing articles therefrom. The articles are received at an open upper end of the tube through a funnel. The guide rings are manipulated by solenoids to thereby move the dispensing end of the tube over receiving slots of a packing crate. However, this invention fails to teach orientation of specifically shaped articles. Secondly, this invention fails to teach or suggest a method for breaking the fall of the articles to ensure reception thereof into the receiving slots.

Attempts to create handling apparatus with orientation capacity are disclosed in U.S. Pat. Nos. 3,467,236 (issued Sep. 16, 1969 to R. Dhanda), 2,945,335 (issued Jul. 19, 1960 to C. Nicolle) and 2,911,088 (issued Nov. 3, 1959 to R. M. Ingham, Jr., et al.). These references are directed to the handling of elongate article having a narrow end and an opposing broad end. They teach a pair of stationary, inclined parallel bars for holding the articles in suspended contact therebetween in a vertical position with the narrow end pointing downwardly. The article slide along the bar under the influence of gravity. Although these inventions have achieved orientation of the articles during handling, they introduce increased friction between the articles and the transporting apparatus which competes against gravity. This condition tends to slow transportation of the articles and thus the entire handling process. Further, there is still the problem of orienting the articles prior to positioning between the bars.

Other attempts at article orientation have been made. U.S. Pat. Nos. 3,884,347 (issued on May 20, 1975 to Gallagher et al.) and 2,377,431 (issued on Jun. 5, 1945 to E. E. Lakso) teach parallel rotating cylinders for supporting articles therebetween. The cylinders include helical grooves, and helical ridges, respectively, about the exterior of the cylinders, which operate to orient the article. The Gallagher patent adds magnetization to the orientation process. The Lakso patent adds a conveyor belt below the cylinders to maintain the articles between said cylinders. Although an orienting capability is achieved by these inventions, it requires additional structure and expense.

OBJECTS AND SUMMARY OF THE INVENTION

It is therefore an object of the present invention to provide a portable, bench top loader system for feeding unorganized articles into organized gravity-driven transport as part of a distribution process, while minimizing kinetic friction against the articles.

It is an additional object of the present invention to provide such a system which can feed and transport the articles without human handling of the articles.

It is another object of the invention, in accordance with one aspect thereof, to provide such a system which orients the articles into a vertical alignment prior to distribution thereof.

It is a further object of the invention, in accordance with one aspect thereof, to provide such a system which feeds the articles one by one into receiving slots narrowly tailored to the shape of the articles.

It is still another object of the invention, in accordance with one aspect thereof, to provide such a system for orienting and feeding hollow, conical pipette tips tip-first into narrowly tailored receiving slots.

It is an additional object of the invention to provide such a system, in accordance with one aspect thereof, for reinserting articles which have inadvertently fallen out of transport back into transport without the need for human handling of the articles.

The above objects and others not specifically recited are realized in an illustrative embodiment of a system for transporting by gravity a single-file series of elongate, tapered articles along an inclined transport path for distribution into receiving slots. The system includes a hopper for holding a supply of the articles and a pair of adjacently parallel rotating cylinders for holding the articles in suspended, sliding contact therebetween. A cleated conveyor belt carries the articles from the bottom of the hopper to a point above the cylinders and drops them onto said cylinders. The base of the hopper defines an inclined movement path to thereby convey articles which might fall from the cylinders back to the conveyor belt. The articles are thus fed by the conveyor onto the cylinders and slide along the gap therebetween to an end location. A series of three gates manipulates the articles one at a time to drop in a vertical orientation into an array of narrowly-tailored receiving slots in a packing rack.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
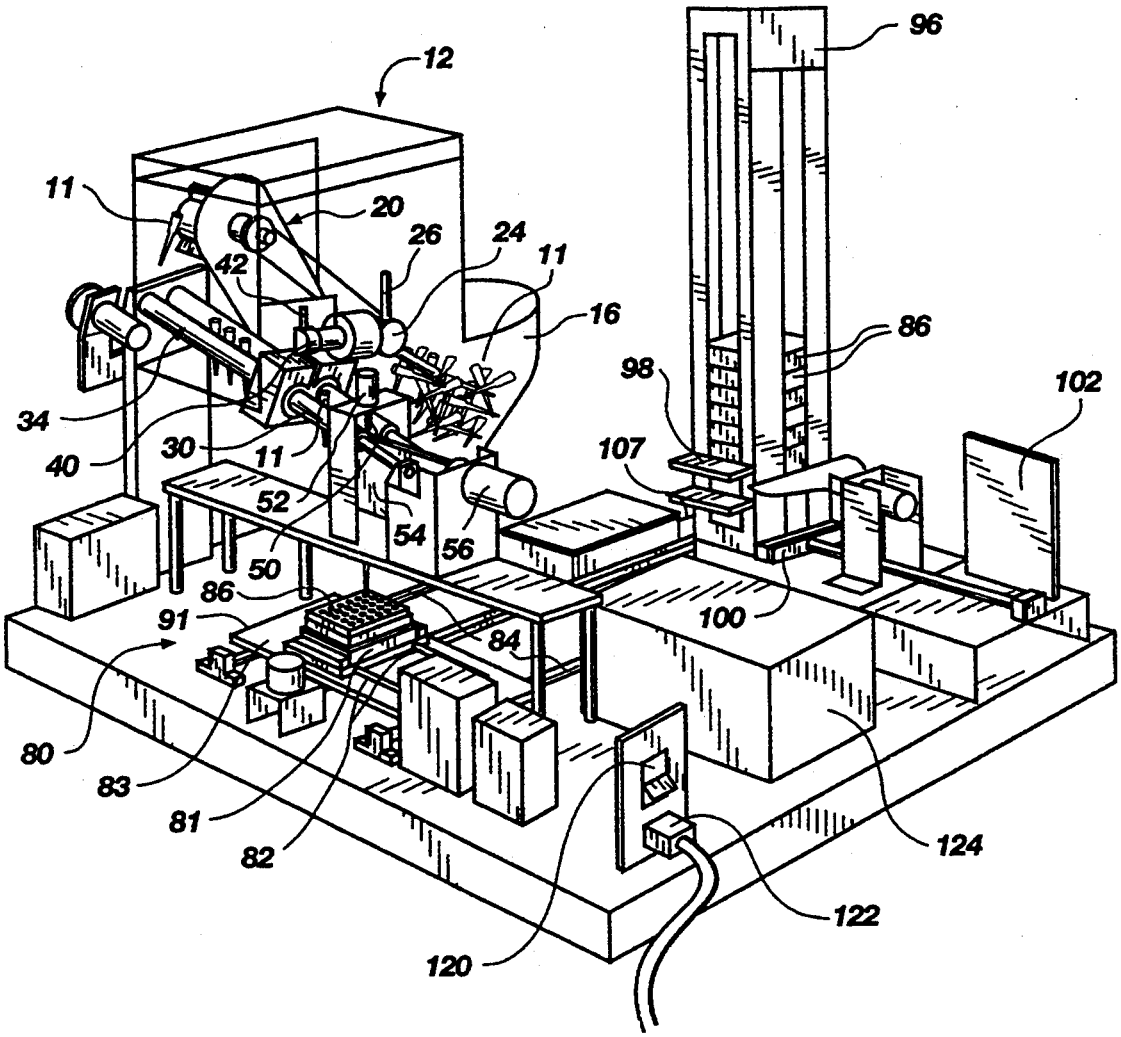
FIG. 1 illustrates a perspective view of a portable, bench top loading system made in accordance with the principles of the present invention.

Reference will now be made to the drawings wherein like structures will be provided with like reference numerals.

FIG. 1 shows a pipette tip orienting and feeding system 10 generally in association with pipette tips 11 contained in the hopper 12. The tips 11 include an open, broad end 11*a* and an opposing tip end 11*b* (see FIGS. 3–4) and are hollow, elongate and conical. A conveyor belt 20 with cleats 21 extending outward therefrom is disposed in the hopper 12. A pair of inclined cylindrical rollers 30 are disposed in the hopper 12. The rollers 30 and conveyor 20 are driven by motors 15 and 17, respectively. A series of three gates, namely, a finger gate 50, an arm gate 54 and a catching gate 58 (not shown in FIG. 1) are all disposed near the lower end 36 of the inclined rollers 30. A rack positioner 80 is disposed below the rollers 30 and is independently moveable upon either of two perpendicular pairs of rails 82 and 84. A magazine assembly 96 is disposed adjacent one end of the rails 84.

Figure 2:
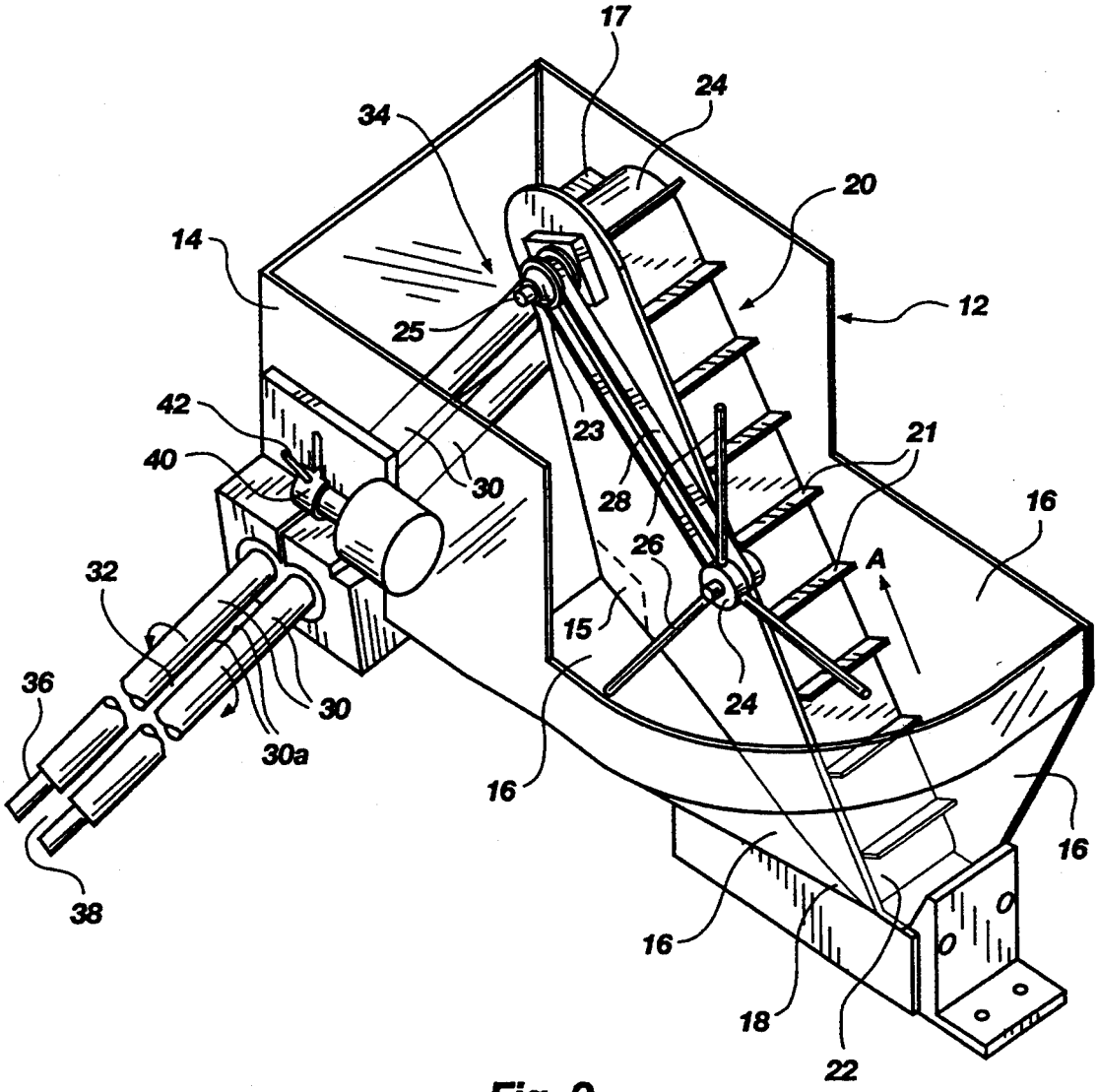
FIG. 2 shows a perspective view of the hopper and conveyor portion of the system of FIG. 1.

Referring now to FIG. 2, the hopper 12 and related apparatus are shown in greater detail. The hopper 12 is formed from walls which define an upper portion 14, a base section 16, and a closed bottom 18. The rollers 30 include a first section 34 disposed in the upper portion 14, and extend out of the hopper 12. The conveyor belt 20 includes a lower end 22 disposed at the bottom 18 of the hopper, and an upper end 24 disposed above the first section 34 of the rollers 30. The base section 16 tapers inwardly toward the bottom 18 as shown to thereby define an inclined movement path leading inward toward the lower end 22 of the conveyor belt 20. An rotating agitation wheel 24 includes a plurality of elongate prongs 26 extending outward therefrom. A belt 28 rotatably intercouples the agitation wheel 24 with a wheel 23 which is rigidly attached to a rotating axle 25 of the conveyor.

Figure 3:
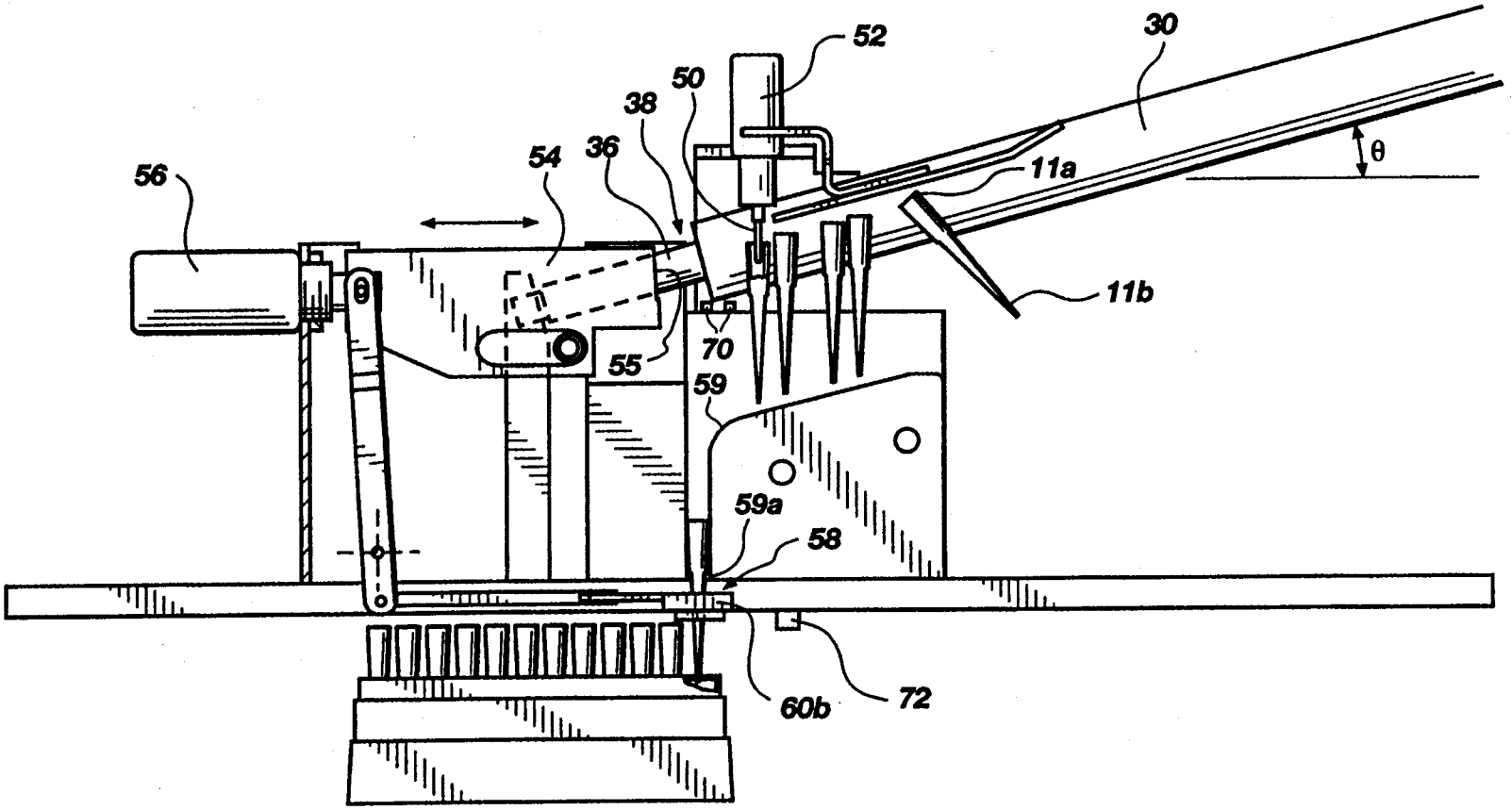
FIG. 3 shows a side view of one of the cylinders and the gates of the system of FIG. 1, with the finger gate and the catching gate in closed positions.
Figure 4:
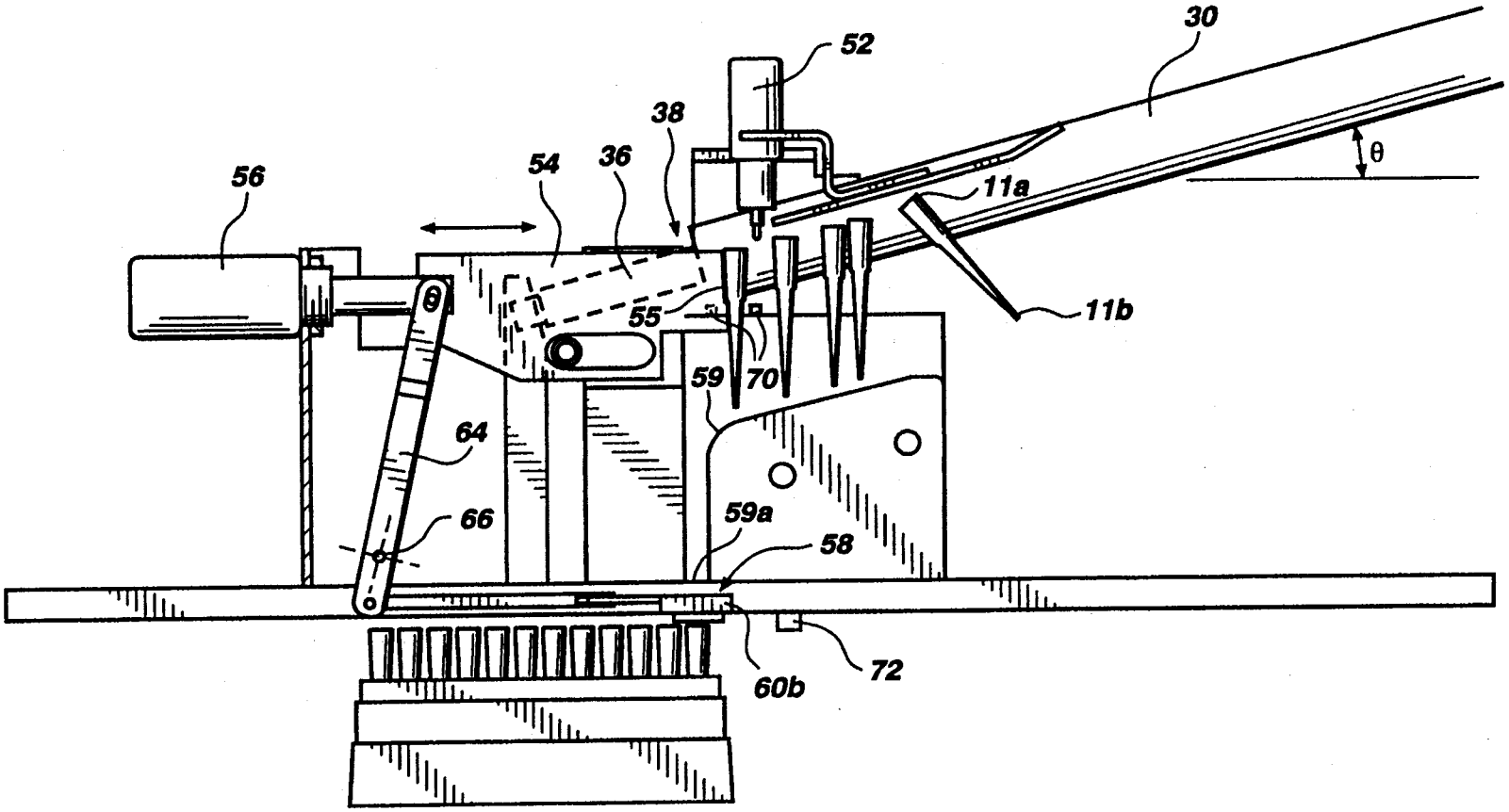
FIG. 4 shows the side view of FIG. 3, with the finger gate and the catching gate in open positions.

Referring now to FIGS. 3–4 in light of FIG. 2, the rollers 30 and the gates are shown in greater detail. FIGS. 3–4 illustrate a side view of the cylinder/gates interface, with one of the rollers 30 removed. The inclined rollers 30 have substantially identical dimensions and are disposed in substantially parallel, adjacent relation. The rollers include elongate, adjacent portions 30*a* which define an inclined, elongate gap 32 therebetween. The gap 32 is wider than the tip end 11*b* of the tips 11 and narrower than the open, broad end 11*a* of said tips. The adjacent surface portions 30*a* are preferably common to a single plane which is level in a direction perpendicular to direction of movement of the long axes of the rollers 30.

The rollers 30 have reduced diameters at their lower end 36 to thereby form an end gap 38 which is wider than the open, broad end 11*a* of the tips 11. Said rollers are inclined by an angle $\theta$ as shown, which is preferably within a range of approximately ten degrees to twenty degrees. The angle $\theta$ is most preferably approximately fifteen degrees. A rotatable sorting wheel 40 includes a plurality of bristles 42 extending radially outward therefrom.

Referring now more specifically to FIGS. 3–4, it is noted that the tips 11 are held by the adjacent portions 30*a* of the rollers 30 in suspended contact therebetween. It is to be understood that the gap 32 and the space directly above and beneath said gap, denote a transport path of the tips 11, in that the tips slide along the gap 32 as will be explained later in more detail. The finger gate 50 is positioned above the transport path just upstream from the end gap 38 in a substantially vertical orientation. The finger gate 50 is connected to a controlling solenoid 52. The arm gate 54 is positioned downstream from, and in front of, the finger gate 50 in a substantially horizontal orientation. The arm gate 54 includes a distal edge 55 custom tailored to fit the exterior side of the tips 11, and is connected to a controlling solenoid 56.

Figure 5A:
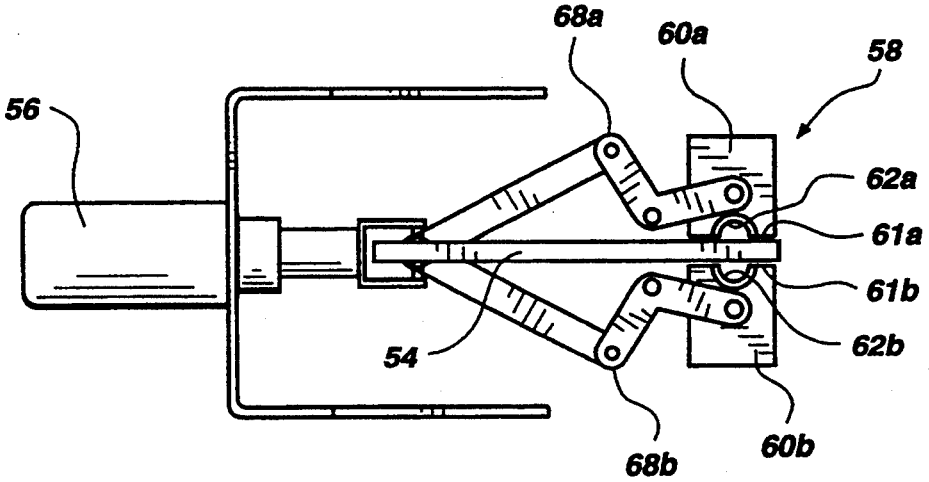
FIG. 5A shows a top view of the arm gate and the catching gate of the system of FIG. 1, with the arm gate in a closed position and the catching gate in an open position.
Figure 5B:
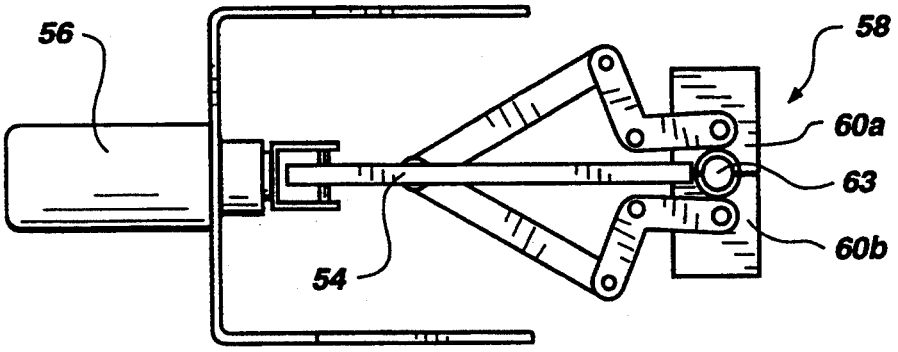
FIG. 5B shows the top view of FIG. 5A, with the arm gate in an open position and the catching gate in a closed position.

Referring now to FIGS. 5A and 5B in light of FIGS. 3–4, the catching gate 58 is shown in greater detail. A funnel member 59 is disposed substantially directly beneath the end gap 38, and includes a lower end 59*a*. The catching gate 58 includes first and second opposing members 60*a* and 60*b* disposed beneath the lower end 59*a* of the funnel 59. Said members 60*a* and 60*b* include opposing free edges 61*a* and 61*b* having opposing apertures 62*a* and 62*b*, respectively, formed therein. A main linkage 64 is coupled to the arm gate 54 and is pivotally attached about pivot point 66. First and second linkages 68*a* and 68*b* intercouple the first and second members 60*a* and 60*b*, respectively, to the main linkage 64. The main linkage 64 intercouples said first and second linkages 68*a* and 68*b* to the arm gate 54. A pair of first sensors 70 are disposed above the funnel member 59, and a second sensor 72 is disposed below the catching gate 58. The sensors 70 and 72 preferably include infrared LED light emitting diodes and corresponding infrared detectors as known in the art.

Figure 6:
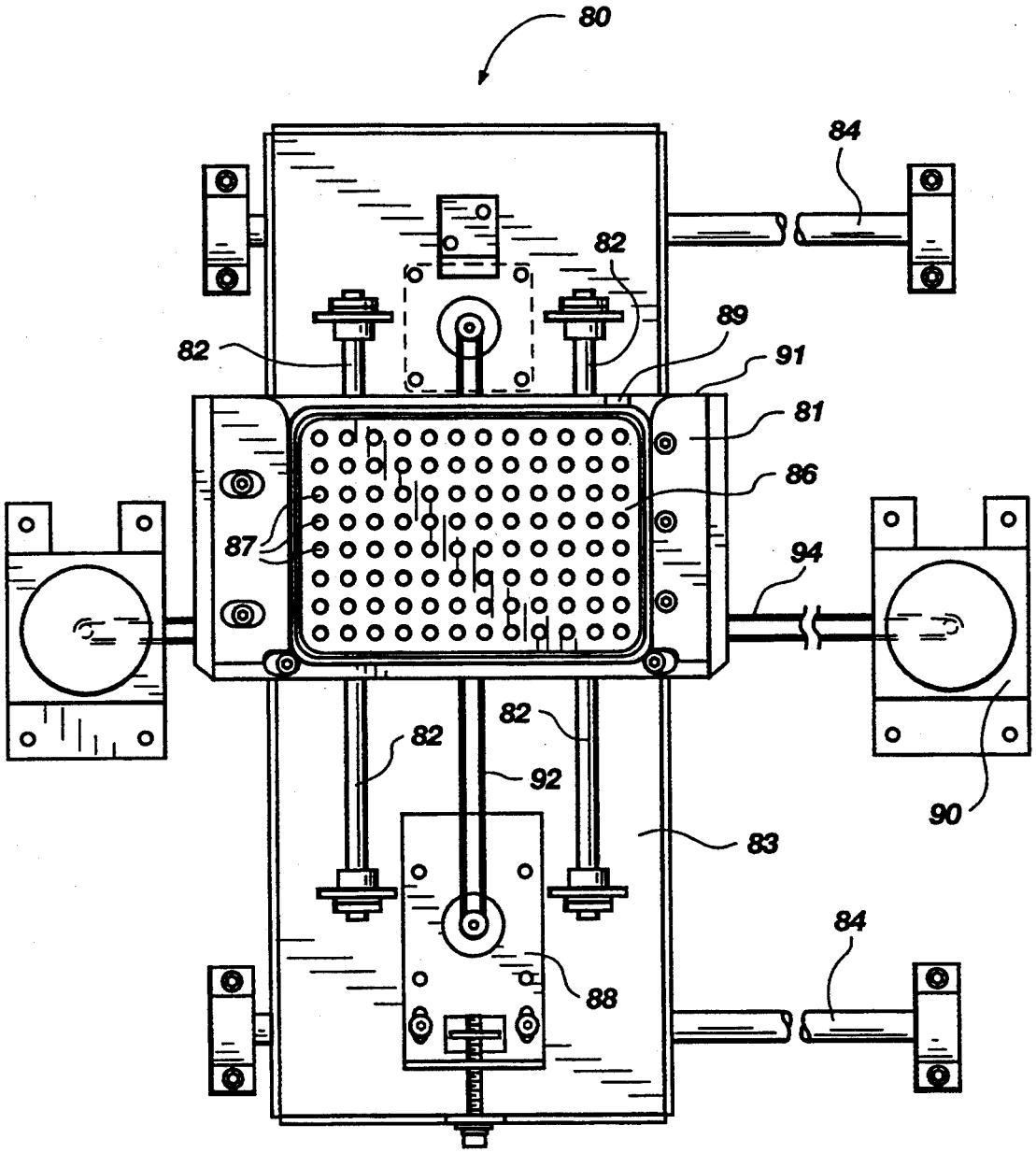
FIG. 6 shows a top view of the rack positioner of the system of FIG. 1.

FIG. 6 illustrates the rack positioner 80 in more detail. An upper table 81 is slidably mounted on a first pair of horizontally positioned parallel rails 82. The rails 82 are in turn mounted upon a lower table 83, which is slidably mounted on a second pair of horizontally positioned parallel rails 84. The pairs of rails 82 and 84 are in substantial perpendicular orientation relative to each other as shown. The upper and lower tables 81 and 83 are slidable independently from each other, which allows right-angle, positional manipulation of a rack 86 placed on the upper table 81. The rack 86 includes a plurality of slots 87 formed therein which are narrowly tailored to receive the tips in a fitted, secured position. The tables 81 and 83 are moved along the rails 82 and 84 by upper and lower stepper motors 88 and 90, respectively. Cables 92 and 94 interconnect the motors 88 and 90 with the tables 81 and 83, respectively, as known in the field.

The magazine 96 shown in FIG. 1 contains a vertical stack of the racks 86 to be filled with the tips 11. A solenoid-actuated gate 98 operates to allow the racks to fall one at a time from the magazine 96 and in front of a ram 100.

Figure 7:
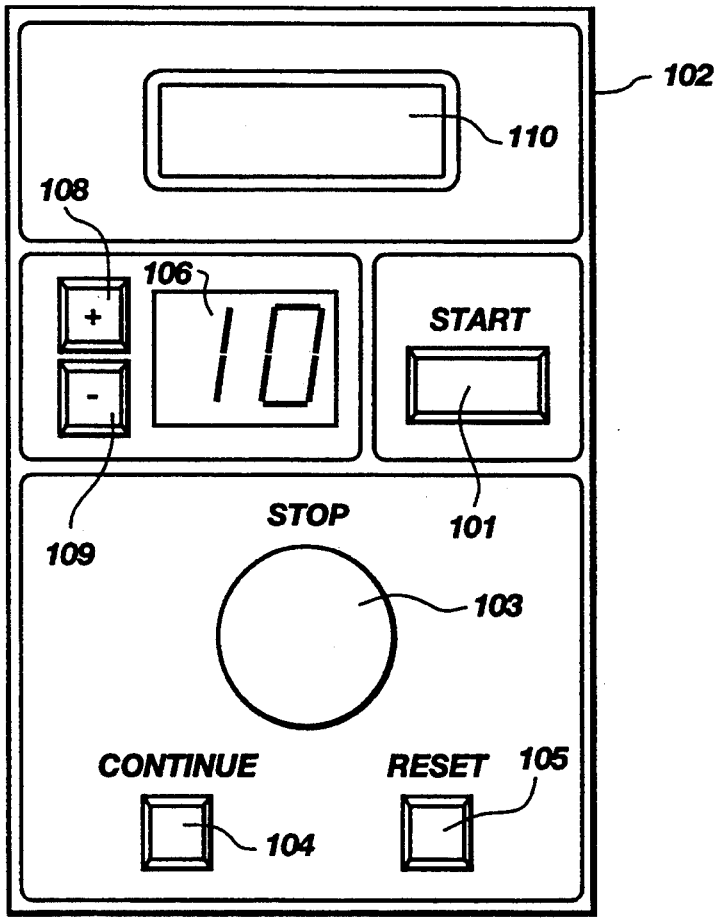
FIG. 7 shows the control panel of the system of FIG. 1.

Referring now to FIG. 7, the system 10 includes a control panel 102, the features and operation of which can be understood by those having ordinary skill in the field. The operator activates the pipette feeding process by pressing a start button 101. Prominently located on the panel 102 is a red stop button 103 which, if pressed, will immediately stop the system 10. Restart is not possible until the button stop 103 is pulled outward. The operator must thereafter choose between continuing the process by pressing a continue button 104, or resetting the system 10 to start over by pressing a reset button 105. If a rack 86 is only partially loaded when the reset button 105 is pressed, the rack will be pushed onto an exit ramp 107. In a preferred embodiment, the continue and reset buttons 104 and 105 are not active unless the stop button 103 has been pressed and thereafter pulled outward. When said buttons 104 and 105 are active, indicator lights located above them flash on and off.

The number of racks 86 within the magazine 96 is displayed on a screen 106 of the control panel 102 by two red digits, defaulted to the number ten. If the operator does not desire to load the default of ten racks, there are two buttons 108 and 109 on the control panel labeled + and −, respectively. These buttons 108 and 109 can be repeatably pressed until the correct number of racks to be loaded is shown on the screen 106, This adjustment must be made prior to pressing the start button 101.

The control panel 102 also includes an LCD display 110 which provides information on status and errors that are detected by the system 10, It also provides instructions to the operator as to how to correct an error, The following is a representative list of messages than can be displayed on the LCD display 110:

| Message no.: | Message: |
|---|---|
| GENERAL: | |
| 000 | <spaces> |
| 001 | SORENSON BioScience |
| 002 | Bench-top Loader |
| 003 | — |
| STATUS: | |
| 040 | OKAY |
| 041 | Loading Rack |
| 042 | Changing Rack |
| 043 | when ready. |
| 044 | Press START |
| 045 | or Continue |
| 046 | Press RESET |
| 047 | STOP button engaged |
| 048 | Rack Positioner Returning Home |
| 049 | Calibrating Rack Positioner |
| 04A | To Calibrate |
| 04B | — |
| 04C | Racks shown on LED's |
| 07F | STATUS |
| ERRORS: | |
| 080 | ADD RACKS |
| 081 | Error, XY HARDWARE |
| 082 | Error, PRC HARDWARE |
| 083 | Error, DSP HARDWARE |
| 084 | DOOR OPEN |
| 085 | ADD TIPS TO HOPPER |
| 086 | TIP JAM (Zone 1) |
| 087 | TIP JAM (Zone 2) |
| 088 | PLATFORM BINDING |
| 089 | AUTO RACK ERROR |
| 08A | TIP NOT SEATED |
| 08B | CALL FOR SERVICE |
| 08C | RACK POSITION MOTOR BINDING |
| 08D | DISPLAY HARDWARE |

-continued

| Message no.: | Message: |
|---|---|
| 08E | TIP NOT IN FUNNEL |
| 0BF | ERRORS |

The purpose and operation of the elements identified above will be discussed in more detail below, and in reference to FIGS. 1–7.

In use, an operator fills the base 16 of the hopper 12 with a supply of the pipette tips 11, then presses the start button 101 to activate the system 10. The solenoid-actuated gate 98 is activated to cause one rack 86 to fall in front of the ram 100. At the same time, the rack positioner 80 is commanded to move the upper table 81 to a position in front of the magazine 96. A motor (not shown) connected to the ram is energized to cause the ram 100 to move toward and push the fallen rack onto the upper table 81. The ram 100 continues to move until the rack encounters a latching mechanism 89 disposed on the upper table 81. As the rack 86 presses against the latch 89, the motor driving the ram 100 begins to bind. This signals the motor to disengage and reverse the ram 100. The rack positioner 80 then moves the rack 86 in accordance with pre-programming such that one of the slots 87 lies directly beneath the catching gate 58. The rack positioner 80 is controlled by programmable circuitry as known in the field. Said rack position is also calibrated to a reference home position and is programmed to determine whether the tables 81 and 83 are moving on command.

The pressing of the start button 101 also causes the conveyor belt 20 and the rollers 30 to rotate. The conveyor belt moves in the direction designated by arrow A in FIG. 2. The rotation of conveyor axis 25 causes rotation of the wheel 23, which in turn cooperates with the belt 28 to cause rotation of the agitation wheel 24. The prongs 26 are thereby rotated about the axis of the wheel 24, which is generally lateral relative to the long axes of said prongs. Applicant has found that the tips 11 tend to nest within each other as a result of being hollow and tapered. The purpose of the agitation wheel 24 is to cause the prongs 26 to repeatably stir the tips 11 and thereby prevent them from nesting. Other agitating methods can be used, such as vibrating the hopper 12, for example.

The cleats 21 of the conveyor belt 20 are configured for grabbing tips 11 from the bottom 18 of the hopper 12. The conveyor belt 20 carries the tips to the upper end 24 and drops them onto the first section 34 of the rollers 30. The gap 32 is wider than the tip end **11*b* and narrower than the open broad end 11*a*. The broad ends 11*a* of the tips thereby become caught between the rollers 30 in the gap 32. This permits gravity to urge the tip 11*b* end downward below the gap 32 such that the tips 11** become suspended transversely relative to said gap.

The rollers 30 rotate in continuous counterrotation with each other about their longitudinal axes, preferably in the direction shown in FIG. 2. The elongate adjacent portions **30*a* are thereby caused to move in a continuous, upward direction along the gap 32. Applicant has found that this particular rotational direction inhibits wedging of the tips 11 between the surface portions 30*a* of the rollers 30. It will be appreciated that, alternatively, one of the rollers 30 remain stationary while the other is rotated, or said rollers may be rotated in the same rotational direction. A further alternative is to counterrotate the rollers 30 in a downward direction along the gap 32. The rollers 30 may alternatively comprise other rounded, elongate members, such as cones, for example. Further, one of the rollers may instead comprise a stationary, noncircular member. It will thus be appreciated that any combination of adjacent surfaces 30***a*, with at least one rotating, is within the scope of the invention.

The rotating action of the rollers 30 reduces kinetic friction between the contacting surface portions 30*a* and the tips 11. The inclination of the rollers by the angle $\theta$ allows gravity and the reduction in friction to cooperatively cause the tips 11 to slide downwardly along the inclined gap 32 in a single-file series. The tips slide in suspension between the surface portions 30*a* in substantial vertical alignment. It will be appreciated that the speed with which the tips 11 slide along the gap 32 is a function of the following variables: (1) the angle $\theta$ of inclination of the rollers 30; (2) the angular velocity of the rotating rollers 30; and (3) whether one or both of the rollers are rotating. The sliding speed of the tips may therefore be controlled by variation of these variables.

When the tips 11 are dropped onto the first section 34 of the rollers 30, some of said tips fall off of the rollers before having a chance to become lodged within the gap 32. These tips fall back into the base 16 of the hopper 12. Occasionally, other tips become caught between, or nested within, adjacent tips, or otherwise fail to enter the gap 32 sufficiently to achieve a vertical orientation. The rotating sorting wheel 40 is positioned relative to the rollers 30 such that said distal extremities of the bristles 42 pass slightly above the tips which are unnested and properly aligned within the gap 32. Any tip which is nested within another tip or is not vertically aligned within the gap 32 resides above the properly aligned tips and is thus engagable with the bristles 42. Such tips are thereby pushed out of the gap 32 and fall back into the base 16 of the hopper 12.

The tips which fall off of the rollers 30 or which are kicked off by the sorting wheel 40 fall back onto the tip supply in the hopper 12. The configuration of the hopper base 16 causes these tips to settle back down to the hopper bottom 18. These tips are again grabbed by the cleats 21 and carried by the conveyor belt 20, until all of the tips 11 have been transported by the rollers 30 out of the hopper 12. It will be appreciated that the combination of the hopper base 16 configuration, the sorting wheel 40, and the conveyer 20 provides that all tips are eventually carried out of the hopper 12.

The tips 11 which are allowed to slide beyond the sorting wheel 40 and out of the hopper 12 form a single-file series which proceeds downward along the rollers 30 to the end gap 38. The arm gate 54 is in a closed position as shown in FIG. 4, in that it resides within the end gap 38 to block movement of the tips 11. The custom edge 55 of the arm gate 54 correspondingly fits the exterior contours of the tips 11 to maintain said tips, which are prone to swinging, in a vertical alignment as in FIG. 4. When a tip 11 comes to rest against the custom edge 55, its presence is sensed by at least one of the sensors 70. The finger gate 50 and the arm gate 54 are preferably spaced apart such that when the arm gate is in a closed position as in FIG. 4, only one tip can pass beyond the finger gate 50 to fit between said finger gate and said arm gate. This condition allows the first tip to block movement of a following tip, such that the finger gate 50 has time to move downward into the transport path to thereby block movement of said following tip when the arm gate is opened.

The sensors 70 are preferably light-emitting diodes and detectors as noted above and operate to reflect light off of objects and detect the reflected light as known in the field. The sensors 70 perform redundant sensing functions. Applicant has found that the tips 11 cannot always be consistently placed into an exact, reproducible position, such that a single sensor 70 might not always sense the presence of a tip. Two sensors 70 provide consistent sensing capacity.

When at least one of the sensors 70 senses a first tip resting against the arm gate 54, its infrared detector generates a first signal sequence in that a signal is conveyed to a process control, which then sends a corresponding signal to the solenoid driving electronics of the solenoids 52 and 56. This first signal sequence causes three events: (1) the solenoid 52 moves the finger gate downward into the transport path to block the tip following the first tip resting against the arm gate 54; (2) the solenoid 56 pulls the arm gate 54 away from the finger gate 52 and at least partially out of the end gap 38; and (3) the main linkage 64 is caused to pivot (counter-clockwise in FIGS. 3–4) about pivot point 66 by the movement of the arm gate 54. Said main linkage 64 thereby pushes upon the first and second linkages 68*a* and 68*b* to cause the catching gate 58 to close as in FIG. 5B by moving the opposing members 60*a* and 60*b* together. When said opposing members are pushed together, the opposing apertures 62*a* and 62*b* cooperate to form a receiving passage 63. This allows the first tip to fall through the end gap 38, into the funnel member 59, and into the receiving passage 63 of the catching gate 58 as shown in FIG. 3.

At this point, the finger gate 52 is blocking the tip which follows the first tip, and the catching gate is holding the first tip in close proximity to, and directly above, one of the receiving slots 87 formed in the rack 86. The sensor 72 then senses the presence of the first tip hanging from catching gate 58 and generates a second signal sequence in the manner of the first signal sequence. This second signal sequence causes two events: (1) the solenoid 56 pushes the arm gate 54 back into the closed position as in FIG. 4; (2) the movement of the arm gate causes the main linkage 64 to pivot about the pivot point 66 (clockwise in FIGS. 3–4). Said main linkage 64 thereby pulls upon the first and second linkages 68*a* and 68*b* to cause the catching gate 58 to open as in FIG. 5A by moving the opposing members 60*a* and 60*b* away from each other. This allows the first tip to fall directly into a slot 87. It will be appreciated that the funnel member 59 and the catching gate 58 cooperate to maintain the tip in a vertical orientation. The catching gate 58 stops the tip just above the slot 87 to break the fall of the tip and ensure its placement into said slot.

At this point, the sensor 72 senses an absence of a tip hanging from catching gate 58 and generates a third signal sequence in the manner of the previous signal sequences. This third signal sequence causes two events: (1) the solenoid 52 pulls the finger gate 50 upward to thereby release the following tip, which said finger gate 50 had been blocking; said following tip is thereby allowed to slide to rest against the custom edge 55 of the arm gate 54; and (2) at least one of the stepper motors 88 and/or 90 is activated to cause the rack 86 to advance horizontally beneath the catching gate 58 to the next slot 87. The process then repeats itself until the slots 87 are filled with the tips 11. The system is programmed to register an error message on the display 110 if one of the sensors 70 or 72 fails to sense an anticipated event.

The rack positioner 80 operates to move the rack 86 hole by hole at right-angle movements with the aid of any suitable control, for example, electric, electromagnetic, electronic, hydraulic or pneumatic. It is preferred to use electronic control therefore.

With the rack 86 filled with tips 11, the rack positioner 80 returns said rack to the reference home position in front of the magazine 96. The solenoid-actuated gate 98 is again activated and another rack is dropped therefrom and pushed by the ram 100 as explained above with an exception. Now there is a full rack on the upper table 81 which needs to be removed. The presence of the full rack is sensed by a sensor (not shown), which causes another solenoid (not shown) to disengage the latch 89 on the upper table 81. As the ram 100 pushes the empty rack onto the upper table 81, the full rack is pushed thereby past the latch 89, off the far side 91 of said upper table, and onto the exit ramp 107 (see FIG. 1). The empty rack is then carried by the rack positioner beneath the catching gate 58, and the process of feeding pipette tips into the rack is repeated. It will thus be appreciated that in order to fill a plurality of racks 86 with pipette tips 11, a user need only: (1) place a plurality of racks 86 into the magazine 96; (2) fill the base 18 of the hopper 12 with tips 11; and (3) press the start button 101.

The system 10 includes a main power switch 120 (see FIG. 1) which, when pressed, routs line voltage from a cable electricity source 122 to a main power supply 124 and to circuit boards (not shown). The circuit boards convey the line voltage to motors (not shown) which drive the conveyor belt 20 and the rollers 30 as known in the field. The power supply 124 rectifies and filters line voltage and delivers +24 volts to electronic hardware (not shown) of the system 10.

The electronic hardware is not shown specifically in the figures but can be understood by those skilled in the art in light of the following discussion. Electronic hardware is concentrated in a card cage which operates most of the control functions for the system 10. Within the card cage are four circuit boards interconnected by a mother board, namely, (a) a power regulator, (b) a ram drive for the ram 100, (c) a stepper drive for the stepper motors 88 and 90, and (d) a process control. Most other circuit boards in the system 10 are connected directly to the mother board by means of cables. The exceptions are indirectly connected to the mother board through an intermediate circuit board.

The Power Regulator circuit board (not shown) takes +24 VDC from the power supply 124 and produces +12 V and +5 V used by the circuitry. It also delivers a constant current of about 500 milliamps per axis to the stepper motors 88 and 90.

The Ram Drive circuit board controls a dc motor which drives the ram 100. This board provides a changing polarity to the motor which allows ram 100 direction changes. It also monitors the current being flowing through the motor to determine whether or not the motor is binding. If current abruptly increases, it is assumed that the ram 100 has pushed the rack 86 into the correct position and the Process Control board is signaled. Upon reception of this signal the Ram Drive board is commanded to stop the motor.

The Rack Positioner Stepper Drive board controls the movement of the rack positioner 80. It monitors the sensors, turns the stepper motors 88 and 90 on and off, controls their direction and generates error signals when necessary. The Rack Positioner Stepper Drive board makes the rack positioner an intelligent assembly since the circuitry on the board can carry out all necessary functions to move the tables 81 and/or 83 to given locations based on a command from the Process Control Board.

The Process Control Board provides commands to all parts of the system 10 and monitors the result. It controls the action of each function and makes sure that each function has been carried out before proceeding to the next. If an error is encountered, the Process control board makes sure that the operator is notified and that the system 10 is stopped.

The operating sequence of the system 10 is controlled by three microprocessors located on different circuit boards within the unit. One processor controls the control panel 102, another controls the rack positioner 80 and the last controls the system 10 as a whole and is designated the process controller. The LCD processor and the rack positioner processor receive instructions from, and deliver information to the process controller.

Driver components are located on the Rack and Roller Interconnect circuit boards. These components operate in response to commands received from the process controller and cause the solenoids to actuate.

A sensor is located on the upper end of the roller assembly. It monitors whether or not the rollers are full of tips. When this condition is present, a signal is passed to the hopper circuit board where the conveyor and agitator motors are turned off.

Another sensor is located near the bottom 18 of the hopper 12 which monitors the presence of tips 11. If the level of tips 11 in the hopper 12 drops below the sensor, a signal is sent to the process controller and a message is displayed on the LCD display 110. This warns the operator that tips are getting low in the hopper.

Sensors are placed at openings to the hopper 12. If the operator decides to open the hopper, the sensors notify the process controller and the system 10 stops. A message is displayed on the LDC display 110 to notify the operator of the condition. The RESET or CONTINUE buttons become active after first closing the door that was opened.

The present invention represents a significant advance over traditional apparatus and methods of orienting and feeding articles into packaging. It is noted that many of the advantages of the present invention accrue due to the combination of the rollers 30 with the gates 50, 54 and 58. The problems noted above and others not discussed are overcome to a significant degree by the present invention. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. Apparatus for orienting and transporting a single-file series of elongate, tapered articles having a narrow end and a broad end, said apparatus comprising:

first and second surfaces having adjacently disposed surface portions for holding the series of articles in suspended contact therebetween, said surface portions defining an inclined, elongate gap therebetween which is wider than the narrow end of each article and narrower than the broad end of each article to thereby permit gravity to urge the narrow end of each article downward below the gap such that the articles are suspended transversely relative to said gap;

means for rotating at least one of the surfaces to thereby reduce friction between the contacting portion of said surface and the articles such that gravity and the rotating action co-act to cause the articles to slide along the inclined gap from a first location to a second location, said surfaces forming an end gap at the second location which is wider than the broad end of the articles such that said articles drop one at a time from said end gap in a vertical orientation; and means disposed substantially directly below the end gap for (i) maintaining the articles in a vertical orientation as they drop one at a time from the end gap, (ii) stopping and holding each of the articles one at a time in close proximity to, and directly above, a slot narrowly tailored to receive the article, and (iii) releasing the article being held into said slot prior to stopping and holding a following article.

2. An apparatus as in claim 1 wherein said at least one of the surfaces comprises an exterior surface of a first elongate cylinder and wherein the rotating means confines rotation of said first cylinder to a single direction about its longitudinal axis to thereby cause continuous, unidirectional movement of said cylinder along the gap.

3. An apparatus as in claim 2 wherein the first and second surfaces comprise exterior surfaces of first and second elongate cylinders disposed in substantially parallel, adjacent relation, said cylinders having substantially identical dimensions.

4. An apparatus as in claim 3 wherein the rotating means includes means for rotating said second cylinder about its longitudinal axis to thereby reduce kinetic friction between the contacting surface of said second cylinder and the articles to further cause the articles to slide along the inclined gap.

5. An apparatus as in claim 4 wherein the rotating means confines rotation of the first and second cylinders to continuous counterrotation with each other.

6. An apparatus as in claim 5 wherein the rotating means rotates the cylinders such that the exterior surfaces thereof move in a generally upward direction along the inclined gap to thereby inhibit wedging of the article between the contacting surface portions of said cylinders.

7. An apparatus as in claim 3 wherein each cylinder has a reduction in diameter at the second location such that the gap between the cylinders at said second location is wider than the broad end of the articles to thereby cause said articles to fall through the gap at said second location by force of gravity into a receiving means.

8. An apparatus as in claim 1 wherein the first surface comprises the exterior surface of a first rounded, elongate member, and wherein the rotating means includes means for rotating said first elongate member about its longitudinal axis.

9. An apparatus as in claim 8 wherein the second surface comprises the exterior surface of a second rounded, elongate member, and wherein the rotating means includes means for rotating said second elongate member about its longitudinal axis to thereby reduce kinetic friction between the contacting surface of said second elongate member and the articles to further cause the articles to slide along the inclined gap.

10. An apparatus as in claim 9 wherein the degree of inclination of the adjacently disposed elongate surface portions is within a range of approximately ten degrees to twenty degrees.

11. An apparatus as in claim 10 wherein said degree of inclination is approximately fifteen degrees.

12. An apparatus as in claim 7 wherein the adjacently disposed surface portions define a plane which is inclined in the direction of movement of the articles and substantially level in a direction perpendicular thereto, such that gravity tends to urge the articles into a substantial vertical alignment, said apparatus further comprising:

means disposed above the gap for contacting any article which might happen to be misoriented substantially out of vertical alignment or stacked upon another article to thereby remove the article from the gap before the misoriented or stacked article falls through the gap.

13. An apparatus as in claim 12 wherein the contacting means comprises a rotating wheel having bristles extending radially outward therefrom such that distal extremities of said bristles pass slightly above the articles which are unstacked and in substantial vertical alignment to thereby push out of the gap any misoriented or stacked article residing above the vertically-aligned articles.

14. A gating system for controlling the distribution of a single-file series of articles being moved by cooperation of gravity and transport means along an inclined transport path and being vertically dropped from dispensing means formed in said transport means at an end of the transport path, said gating system comprising:

catching means disposed below the dispensing means for moving into the path of an article vertically dropped from the dispensing means to thereby steer and catch said article into a suspended position substantially directly above a receiving slot, and for releasing said article to thereby drop it into said receiving slot; and blocking means disposed adjacent to the transport means for alternately moving into and out of the transport path defined by the transport means to thereby (i) block movement of a following article being moved within the transport means until a preceding article is released from the catching means, and (ii) release said following article in a vertical orientation to thereby allow said following article to drop vertically from the dispensing means formed in the transport means such that the articles are dropped one at a time into the catching means in said vertical orientation and dropped one at a time by said catching means into receiving slots.

15. A gating system as in claim 14 wherein the dispensing means comprises an end gap formed in the transport means at the end of the transport path, the blocking means comprising:

a finger positioned above the transport means upstream from the end gap in a substantially vertical orientation;

means for intermittently moving the finger in a generally linear up-and-down direction alternately into and out of the transport path to thereby block movement of said following article and release said following article when a preceding article is released from the catching means;

an arm positioned downstream from and in front of the finger in a substantially horizontal orientation; and means for intermittently moving the arm in a generally linear, horizontal back-and-forth direction alternately into and out of the end gap to thereby block movement of an article released from the finger and maintain said article in a vertical orientation and release said article to thereby cause said article to drop through the end gap in said vertical orientation into the catching means.

16. A gating system as in claim 15 wherein the blocking means further comprises:

means for sensing the presence of an article being blocked by the arm and for generating a first signal sequence corresponding thereto;

means for sensing the presence of an article suspended from the catching means and generating a second signal sequence corresponding thereto, and sensing the absence of any suspended article in the catching means after having sensed the presence of such an article and generating a third signal sequence corresponding thereto;

wherein the finger moving means comprises means attached to the finger and responsive to the first signal sequence for moving said finger downward into the transport path, and responsive to the third signal sequence for moving said finger upward out of the transport path;

wherein the arm moving means comprises means attached to the arm and responsive to the second signal sequence for moving said arm horizontally into the end gap to a closed position, and responsive to the first signal sequence for moving said arm horizontally out of the end gap;

wherein the finger and the arm are spaced apart such that when the arm is in a closed position only one article can pass beyond the finger to thereby cause said one article to block movement of a following article and allow the finger to move downward into the transport path to thereby block movement of said following article when the arm is moved out of the end gap to release said one article and cause it to drop through the end gap.

17. A gating system as in claim 16 wherein the receiving slots comprise a plurality of slots narrowly tailored to receive the articles in a fitted, secured position, the catching means comprising:

a funnel member disposed substantially directly beneath the end gap for receiving and channeling said one article such that said article falls through a lower end of the funnel member in a vertical orientation;

first and second members disposed beneath the lower end of the funnel and having opposing free edges, each edge having an aperture formed therein; and means attached to the first and second members and responsive to the first signal sequence for moving said opposing free edges toward each other to thereby position the apertures into opposing adjacent proximity such that said apertures form a receiving passage directly beneath the lower end of the funnel member which is narrower than a portion of the article for catching said article in a position directly above one of the narrowly-tailored slots to thereby prevent said article from missing said slot, and responsive to the second signal sequence for moving said opposing free edges away from each other to thereby drop the article into said slot.

18. A gating system as in claim 17 wherein the means for moving the free edges comprise:

first linkage means coupled to the first member and moveable to cause said first member to move toward or away from the second member;

second linkage means coupled to the second member and moveable to cause said second member to move toward or away from the first member;

moving means pivotally attached to the first and second linkage means and moveable generally linearly in a back and forth direction to thereby cause said first and second linkage means, and first and second members, respectively, to move.

19. A gating system as in claim 18 wherein the moving means comprises a main linkage means intercoupling the first and second linkage means with the arm and being pivotally mounted at an interior portion thereof, wherein the arm moving means and the means for moving the opposing free edges collectively include a solenoid having driving electronics responsive to the first and second signal sequences for causing the solenoid to move said arm horizontally into and out of the end gap, respectively, such that when the arm is moved into the end gap the main linkage means is pivoted thereby to cause the first and second members to move away from each other, and when the arm is moved out of the end gap the main linkage means is pivoted thereby in an opposite direction to cause the first and second members to move toward each other.

20. A gating system as in claim 16 wherein the means for sensing the presence of the article blocked by the arm and generating a first signal sequence comprises:

at least one light-emitting diode for emitting light onto said blocked article to thereby cause said article to reflect said emitted light; and a light detector for receiving said reflected light and generating the first signal sequence.

21. A gating system as in claim 16 wherein the means for sensing the presence/absence of the article suspended from the catching means and generating second and third signal sequences comprises:

at least one light emitting diode for emitting light onto said suspended article to thereby cause said article to reflect said emitted light; and a light detector for receiving said reflected light and generating the second and third signal sequences.

22. A gating system as in claim 16 wherein the finger moving means comprises a solenoid having driving electronics responsive to the first and third signal sequences for causing the solenoid to move said finger downward into the transport path and upward out of the transport path, respectively.

23. A system for feeding elongate articles onto transport means and transporting said articles comprising:

a hopper having walls defining an upper portion and a closed bottom portion for holding a supply of the articles therein;

transport means having a first section disposed in the upper portion of the hopper and extending out of the hopper for transporting the articles out of the hopper by gravity along an inclined transport path;

a rotating, inclined conveyor belt having a lower end disposed at the bottom of the hopper and an upper end disposed above the first section of the transport means, said conveyor including a plurality of cleats extending outward therefrom and configured for grabbing articles from the bottom of the hopper, carrying said articles to the upper end of the conveyor, and dropping said articles from the upper end onto the first section of the transport means to be transported thereby;

the hopper including a base section configured to define an at least partially inclined movement path leading from a location below the first section of the transport means downward to the bottom of the hopper at a location in close proximity to the lower end of the conveyor belt to thereby cause any articles which might happen to fall from the first section of the transport means to gradually settle downward toward said lower end of the conveyor belt and be eventually grabbed again thereby until all of the articles have been transported by the transport means out of the hopper.

24. A system as in claim 23 wherein the supply of articles comprises a supply of hollow, conical tips, the system further comprising means disposed in the hopper for agitating the tips before said tips are grabbed by the conveyor to thereby inhibit said tips from nesting within each other.

25. A system as in claim 24 wherein the agitating means comprises:

a rotatable wheel having at least one elongate prong extending outward therefrom into the supply of tips; and means for rotating the wheel to cause rotation of the prong about an axis which is generally lateral relative to the long axis of said prong to thereby cause said prong to repeatably stir the supply of tips.

26. A system for transporting by gravity along an inclined transport path a single-file series of elongate, tapered articles having a narrow end and a broad end, and dispensing said articles one at a time into a plurality of slots narrowly tailored to receive the articles in a fitted, secured position, said system comprising:

first and second surfaces having adjacently disposed surface portions for holding the series of articles in suspended contact therebetween, said surface portions defining an inclined, elongate gap therebetween which is wider than the narrow end of each article and narrower than the broad end of each article to thereby permit gravity to urge the narrow end of each article downward below the gap such that the articles are suspended transversely relative to said gap;

means for rotating at least one of the surfaces to thereby reduce friction between the contacting portion of said surface and the articles such that gravity and the rotating action co-act to cause the articles to slide down the inclined gap between the surfaces along a transport path from a first location to a second location, said surfaces forming an end gap at the second location which is wider than the broad end of the articles for dropping the articles therethrough;

catching means disposed below the end gap for moving into the path of an article vertically dropped from said end gap to thereby steer and catch said article into a suspended position substantially directly above one of said slots, and for releasing said article to thereby drop it into said slot; and blocking means disposed adjacent to the transport means for alternately moving into and out of the transport path to thereby (i) block movement of a following article sliding between the surfaces along the transport path until a preceding article is released from the catching means, and (ii) release said following article in a vertical orientation to thereby allow said following article to drop vertically from the end gap formed by the surfaces such that the articles are dropped one at a time into the catching means in said vertical orientation and dropped one at a time by said catching means into the slots.

27. An apparatus as in claim 26 wherein said at least one of the surfaces comprises an exterior surface of a first elongate cylinder and wherein the rotating means confines rotation of said first cylinder to a single direction about its longitudinal axis to thereby cause continuous, unidirectional movement of said cylinder along the gap.

28. An apparatus as in claim 27 wherein the first and second surfaces comprise exterior surfaces of first and second elongate cylinders disposed in substantially parallel, adjacent relation, said cylinders having substantially identical dimensions.

29. An apparatus as in claim 28 wherein the rotating means includes means for rotating said second cylinder about its longitudinal axis to thereby reduce kinetic friction between the contacting surface of said second cylinder and the articles to further cause the articles to slide along the inclined gap.

30. An apparatus as in claim 29 wherein the rotating means confines rotation of the first and second cylinders to continuous counterrotation with each other.

31. An apparatus as in claim 30 wherein the rotating means rotates the cylinders such that the exterior surfaces thereof move in a generally upward direction along the inclined gap to thereby inhibit wedging of the article between the contacting surface portions of said cylinders.

32. An apparatus as in claim 28 wherein each cylinder has a reduction in diameter at the second location to thereby form the end gap, said end gap being wider than the broad end of the articles to thereby cause said articles to fall from between the cylinders at said second location by force of gravity into a receiving means.

33. An apparatus as in claim 26 wherein the first surface comprises the exterior surface of a first rounded, elongate member, and wherein the rotating means includes means for rotating said first elongate member about its longitudinal axis.

34. An apparatus as in claim 33 wherein the second surface comprises the exterior surface of a second rounded, elongate member, and wherein the rotating means includes means for rotating said second elongate member about its longitudinal axis to thereby reduce kinetic friction between the contacting surface of said second elongate member and the articles to further cause the articles to slide along the inclined gap.

35. An apparatus as in claim 26 wherein the degree of inclination of the adjacently disposed elongate surface portions is within a range of approximately ten degrees to twenty degrees.

36. An apparatus as in claim 35 wherein said degree of inclination is approximately fifteen degrees.

37. An apparatus as in claim 32 wherein the adjacently disposed surface portions define a plane which is inclined in the direction of movement of the articles and substantially level in a direction perpendicular thereto, such that gravity tends to urge the articles into a substantial vertical alignment, said apparatus further comprising:

means disposed above the gap for contacting any article which might happen to be misoriented substantially out of vertical alignment or stacked upon another article to thereby remove the article from the gap before the misoriented or stacked article falls through the gap.

38. An apparatus as in claim 37 wherein the contacting means comprises a rotating wheel having bristles extending radially outward therefrom such that distal extremities of said bristles pass slightly above the articles which are unstacked and in substantial vertical alignment to thereby push out of the gap any misoriented or stacked article residing above the vertically-aligned articles.

39. A gating system as in claim 26 wherein the blocking means comprises:

a finger positioned above the transport means upstream from the end gap in a substantially vertical orientation;

means for intermittently moving the finger in a generally linear up-and-down direction alternately into and out of the transport path to thereby block movement of said following article and release said following article when a preceding article is released from the catching means;

an arm positioned downstream from and in front of the finger in a substantially horizontal orientation; and means for intermittently moving the arm in a generally linear, horizontal back-and-forth direction alternately into and out of the end gap to thereby block movement of an article released from the finger and maintain said article in a vertical orientation and release said article to thereby cause said article to drop through the end gap in said vertical orientation into the catching means.

40. A gating system as in claim 39 wherein the blocking means further comprises:

means for sensing the presence of an article being blocked by the arm and for generating a first signal sequence corresponding thereto;

means for sensing the presence of an article suspended from the catching means and generating a second signal sequence corresponding thereto, and sensing the absence of any suspended article in the catching means after having sensed the presence of such an article and generating a third signal sequence corresponding thereto;

wherein the finger moving means comprises means attached to the finger and responsive to the first signal sequence for moving said finger downward into the transport path, and responsive to the third signal sequence for moving said finger upward out of the transport path;

wherein the arm moving means comprises means attached to the arm and responsive to the second signal sequence for moving said arm horizontally into the end gap to a closed position, and responsive to the first signal sequence for moving said arm horizontally out of the end gap;

wherein the finger and the arm are spaced apart such that when the arm is in a closed position only one article can pass beyond the finger to thereby cause said one article to block movement of a following article and allow the finger to move downward into the transport path to thereby block movement of said following article when the arm is moved out of the end gap to release said one article and cause it to drop through the end gap.

41. A gating system as in claim 40 wherein the receiving slots comprise a plurality of slots narrowly tailored to receive the articles in a fitted, secured position, the catching means comprising:

a funnel member disposed substantially directly beneath the end gap for receiving and channeling said one article such that said article falls through a lower end of the funnel member in a vertical orientation;

first and second members disposed beneath the lower end of the funnel and having opposing free edges, each edge having an aperture formed therein; and means attached to the first and second members and responsive to the first signal sequence for moving said opposing free edges toward each other to thereby position the apertures into opposing adjacent proximity such that said apertures form a receiving passage directly beneath the lower end of the funnel member which is narrower than a portion of the article for catching said article in a position directly above one of the narrowly-tailored slots to thereby prevent said article from missing said slot, and responsive to the second signal sequence for moving said opposing free edges away from each other to thereby drop the article into said slot.

42. A gating system as in claim 41 wherein the means for moving the free edges comprise:

first linkage means coupled to the first member and moveable to cause said first member to move toward or away from the second member;

second linkage means coupled to the second member and moveable to cause said second member to move toward or away from the first member;

a piston member selectively moveable generally linearly in a back and forth direction, said piston member being pivotally connected to the first and second linkage means to thereby cause said first and second linkage means, and first and second members, respectively, to move when said piston member is moved.

43. A gating system as in claim 42 further comprising a main linkage means intercoupling the piston member with the arm and being pivotally mounted at an interior portion thereof, wherein the arm moving means and the means for moving the opposing free edges collectively include a solenoid having driving electronics responsive to the first and second signal sequences for causing the solenoid to move said arm horizontally into and out of the end gap, respectively, such that when the arm is moved into the end gap the main linkage means is pivoted thereby to cause the first and second members to move away from each other, and when the arm is moved out of the end gap the main linkage means is pivoted thereby in an opposite direction to cause the first and second members to move toward each other.

44. A gating system as in claim 40 wherein the means for sensing the presence of the article blocked by the arm and generating a signal sequence comprises:

at least one light-emitting diode for emitting light onto said blocked article to thereby cause said article to reflect said emitted light; and a light detector for receiving said reflected light and generating the first signal sequence.

45. A gating system as in claim 40 wherein the means for sensing the presence/absence of the article suspended from the catching means and generating second and third signal sequences comprises:

at least one light emitting diode for emitting light onto said suspended article to thereby cause said article to reflect said emitted light; and a light detector for receiving said reflected light and generating the second and third signal sequences.

46. A gating system as in claim 40 wherein the finger moving means comprises a solenoid having driving electronics responsive to the first and third signal sequences for causing the solenoid to move said finger downward into the transport path and upward out of the transport path, respectively.

* * * * *